United States Patent [19]

Reist

[11] Patent Number: 4,953,843

[45] Date of Patent: Sep. 4, 1990

[54] METHOD OF, AND APPARATUS FOR, LOADING A SINGLING INSTALLATION FOR PRINTED PRODUCTS

[75] Inventor: Walter Reist, Hinwil, Switzerland

[73] Assignee: Ferag AG, Hinwil, Switzerland

[21] Appl. No.: 223,958

[22] Filed: Jul. 21, 1988

[30] Foreign Application Priority Data

Jul. 24, 1987 [CH] Switzerland ..... 02821/87

[51] Int. Cl.[5] ..... B65H 5/02

[52] U.S. Cl. ..... 271/3.1; 271/184; 271/306; 271/303; 271/902; 242/59

[58] Field of Search ..... 271/3.1, 216, 69, 184, 271/199, 202, 301, 306, 302, 303, 304, 902; 270/54, 60; 242/59

[56] References Cited

U.S. PATENT DOCUMENTS

| | | | |
|---|---|---|---|
| 3,945,635 | 3/1976 | Marin | 271/202 |
| 4,214,743 | 7/1980 | Meier | 271/184 |
| 4,266,654 | 5/1981 | Achelpohl et al. | 271/302 |
| 4,525,982 | 7/1985 | Meier Jr. | 242/59 |
| 4,550,883 | 11/1985 | Boss | 242/59 |
| 4,569,488 | 2/1986 | Baltisberger | 242/59 |
| 4,575,988 | 3/1986 | Meier . | |
| 4,595,192 | 1/1986 | Reist | 242/59 |
| 4,597,541 | 7/1986 | Leu | 242/59 |
| 4,684,118 | 8/1987 | Boss et al. | 242/59 |
| 4,718,656 | 1/1988 | Reist | 271/202 |

FOREIGN PATENT DOCUMENTS 654553 2/1986 Switzerland .

*Primary Examiner*—H. Grant Skaggs

*Attorney, Agent, or Firm*—Bell, Seltzer, Park & Gibson

[57] ABSTRACT

A separation arrangement removes printed products from an arriving imbricated stream of printed products and supplies such to a buffer branch arrangement. The non-removed printed products arrive at a feeder installation from an infeed device where there is first formed an imbricated buffer stack of printed products. The removed printed products are wound for temporary storage at the buffer branch arrangement in an imbricated or shingled formation with a buffer winding band upon a winding core or mandrel to form a buffer package. Upon interruption of the arriving imbricated stream of printed products these printed products stored in the buffer package are unwound and delivered to the infeed device, so that the supply of the imbricated stream of printed products is not interrupted. Since the buffer package possesses an appreciable storage capacity it is also possible to span longer interruptions of the infed imbricated stream of printed products without having to shutdown the feeder installation.

22 Claims, 4 Drawing Sheets

METHOD OF, AND APPARATUS FOR, LOADING A SINGLING INSTALLATION FOR PRINTED PRODUCTS

BACKGROUND OF THE INVENTION

The present invention relates to a new and improved method of, and apparatus for, loading or charging a singling or separation apparatus or installation for products, such as printed products, especially a feeder or feeder installation.

Generally speaking, the apparatus for loading or charging a singling apparatus or installation for printed products, especially a feeder or feeder installation, with printed products delivered in an imbricated or shingled stream or formation, contemplates forming an imbricated buffer stack of printed products by reducing, prior to or upstream of the singling installation, the imbrication spacing or pitch of the products in the arriving imbricated stream of printed products so as to form the imbricated buffer stack of printed products.

Also as indicated previously, the invention equally relates to an apparatus for loading or charging a singling installation or apparatus, especially a feeder installation, which is of the type comprising an infeed device which reduces the imbrication spacing or pitch of the printed products of an arriving imbricated or shingled stream or formation of the printed products so as to form an imbricated buffer stack or buffer of printed products and then delivers or conveys the printed products to the singling or separation installation.

Such general type of method and apparatus are disclosed in the German Published Pat. No. 3,608,055, the cognate British Published patent application No. 2,174,681, and the cognate U.S. Pat. No. 4,718,656, granted Jan. 12, 1988. The printed products of the arriving imbricated stream or formation, prior to their infeed to the singling or separation installation or apparatus, are pushed together into a reposing buffer stack by reducing the mutual spacing between or pitch of the products. The length of this buffer stack alters as a function of the infeed rate of the arriving printed products and the withdrawal velocity of printed products from the buffer stack. If, for instance, the arriving imbricated stream of printed products is interrupted, then the buffer stack is reduced in size since, as viewed in the product conveying or feed direction, the forwardmost printed product of the buffer stack is withdrawn or extracted and infed to the singling or separation installation. The buffer stack must be subsequently filled, that is to say, again increased in size in that more printed products of the imbricated stream are pushed onto the rear of the buffer stack than printed products are withdrawn at the front side or front of such buffer stack.

The length of the buffer stack must be of such a magnitude that there can be bridged or spanned interruptions in the delivery of the arriving imbricated stream of printed products without having to shutdown further processing of the printed products in the singling installation. The aforementioned U.S. Pat. No. 4,718,656, teaches the manner in which even longer interruptions in the supply of the printed products and the thus caused appreciable length fluctuations of the buffer stack can be effectively controlled or mastered. Such interruptions in the delivery of the printed products can arise, for instance, during the supply of the loading or charging apparatus with printed products emanating from a wound product package upon exchange of an empty winding core for a fully wound product package.

SUMMARY OF THE INVENTION

Therefore with the foregoing in mind and starting with a method and apparatus of the type disclosed in the aforementioned U.S. Pat. No. 4,718,656, it is a primary object of the present invention to limit the fluctuations in the length of the buffer stack to a minimum possible degree while ensuring for a sufficiently large buffer capacity in order to bridge long delivery interruptions, and thus also to reduce the length of the buffer stack to a minimum.

A further significant object of the present invention aims at providing a new and improved method of, and apparatus for, loading or charging a singling or separation installation for printed products in a manner such that there can be effectively coped with interruptions in the delivery or supply of printed products.

Yet a further important object of the present invention is directed to the provision of a new and improved method of, and apparatus for, loading a singling installation for printed products in a manner such that interruptions in the supply of the printed products can be reliably spanned through the provision of a buffer stack of printed products, with fluctuations in the length of such buffer stack being reduced to a minimum and also the length of the buffer stack of printed products also being desirably maintained at a minimum.

A further noteworthy object of the present invention aims at the provision of a new and improved construction of apparatus for loading or charging a singling or separating installation for printed products, which apparatus is relatively simple in construction and design, extremely reliable in operation, relatively economical to manufacture, not readily subject to breakdown or malfunction, and requires a minimum of maintenance and servicing.

Now in order to implement these and still further objects of the invention, which will become more readily apparent as the description proceeds, the method for loading or charging a singling installation for printed products, especially a feeder or feeder installation, with printed products infed or delivered in an imbricated stream or formation, is manifested, among other things, by the features that printed products are removed or detached out of the arriving imbricated stream of printed products and wound to form a buffer package. Upon interruption of the arriving or delivered imbricated stream of printed products, the printed products which have been previously wound into the buffer package are unwound therefrom and delivered to the imbricated or imbrication buffer stack of printed products.

As noted previously, the invention also is concerned with an apparatus for loading or charging a singling installation or apparatus, especially a feeder or feeder installation, with printed products. According to the present invention, there is provided a buffer winding core or core member which is rotatably mounted for rotation in both possible directions of rotation, in other words, is bi-directionally rotatable. This buffer winding core or core member serves for winding thereon a buffer package of printed products and for again unwinding such previously wound printed products from the buffer package. A conveyor arrangement is disposed between the infeed device for the delivery of the printed products and the buffer winding core or core member for the infeed and outfeed, as the case may be, of printed products to form the buffer package and from the buffer package. A separation arrangement serves for releasing or detaching printed products from the arriving imbricated stream or formation of printed products and for the delivery thereof to the conveyor arrangement.

Printed products are removed or detached from the arriving imbricated stream or formation of printed products and wound to form a buffer package. Such buffer packages have an appreciable storage capacity while possessing relatively modest dimensions. In particular, even a slight increase of the package diameter affords an appreciably larger storage capacity. As a result the imbricated buffer stack of printed products can be maintained small in size.

The removal or detachment of printed products out of the arriving imbricated stream of products is simplified in that the printed products of the arriving product stream are singled or separated and either delivered to form the buffer package or to the imbricated buffer stack of printed products.

A particularly large storage density of the buffer package is attained if two printed products repose upon one another and form a pair of printed products. Each such pair of printed products is then infed or delivered to form the buffer package. Preferably, each second printed product or printed product pair, as the case may be, can be removed or released out of the arriving imbricated stream or formation of printed products until sufficient product copies are available at the buffer package for bridging or spanning any possibly arising interruptions in the delivery of the printed products. In this case, the processing speed or velocity of the singling installation is half as great as the infeed rate of the arriving imbricated formation or stream of printed products.

Since in the case of the printed products which are unwound or payed-off from the buffer package the trailing edge of each printed product corresponds to the leading edge of the printed products which are directly infed or supplied to the imbricated or imbrication buffer stack, the printed products which are unwound from the buffer package are preferably singled and there is formed a new imbricated stream or formation, in which the printed products are correctly disposed, in other words, positioned in the same posture or orientation as in the infed imbricated stream or formation of printed products, which is then delivered to the imbricated buffer stack.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
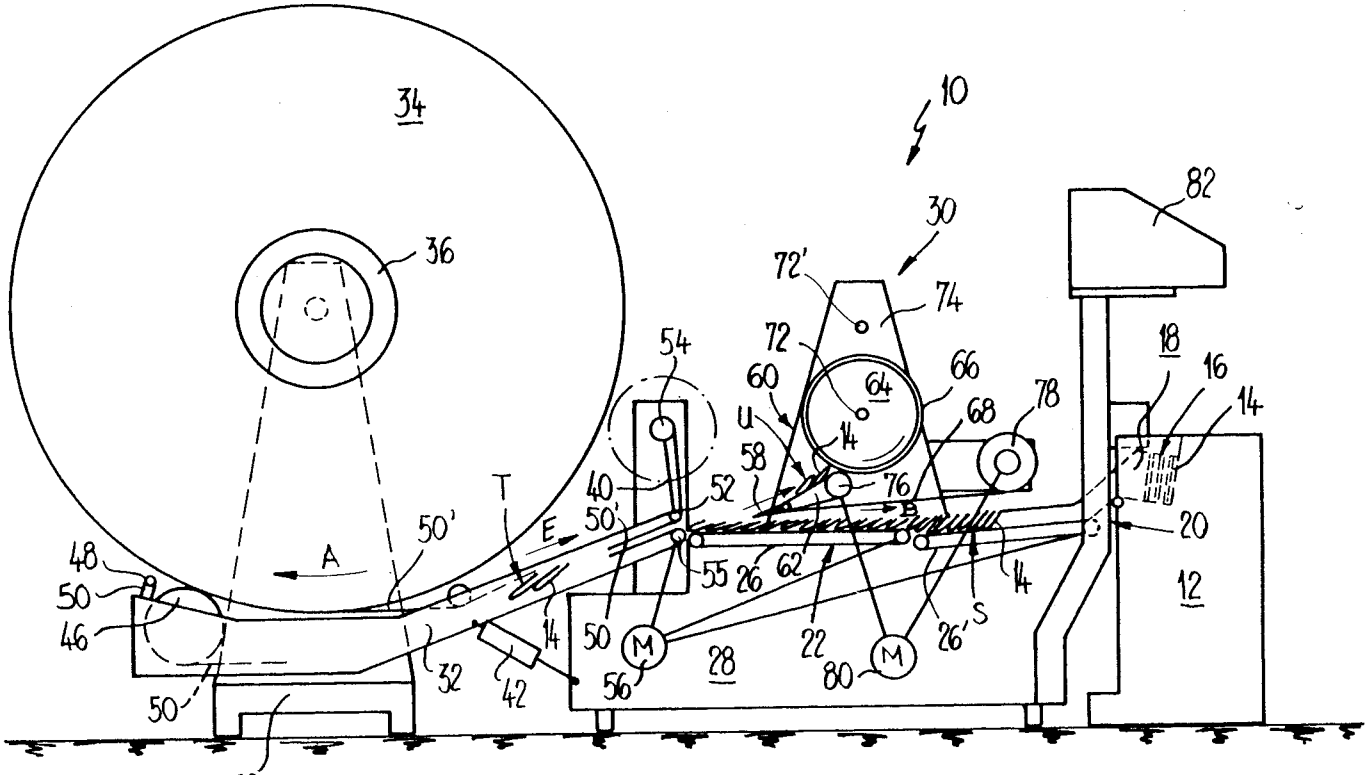
FIG. 1 illustrates in side view and in simplified schematic illustration an exemplary embodiment of a loading or charging apparatus for a feeder or feeder installation, depicting the imbricated buffer or imbricated buffer stack supplied by a wound product package.
Figure 2:
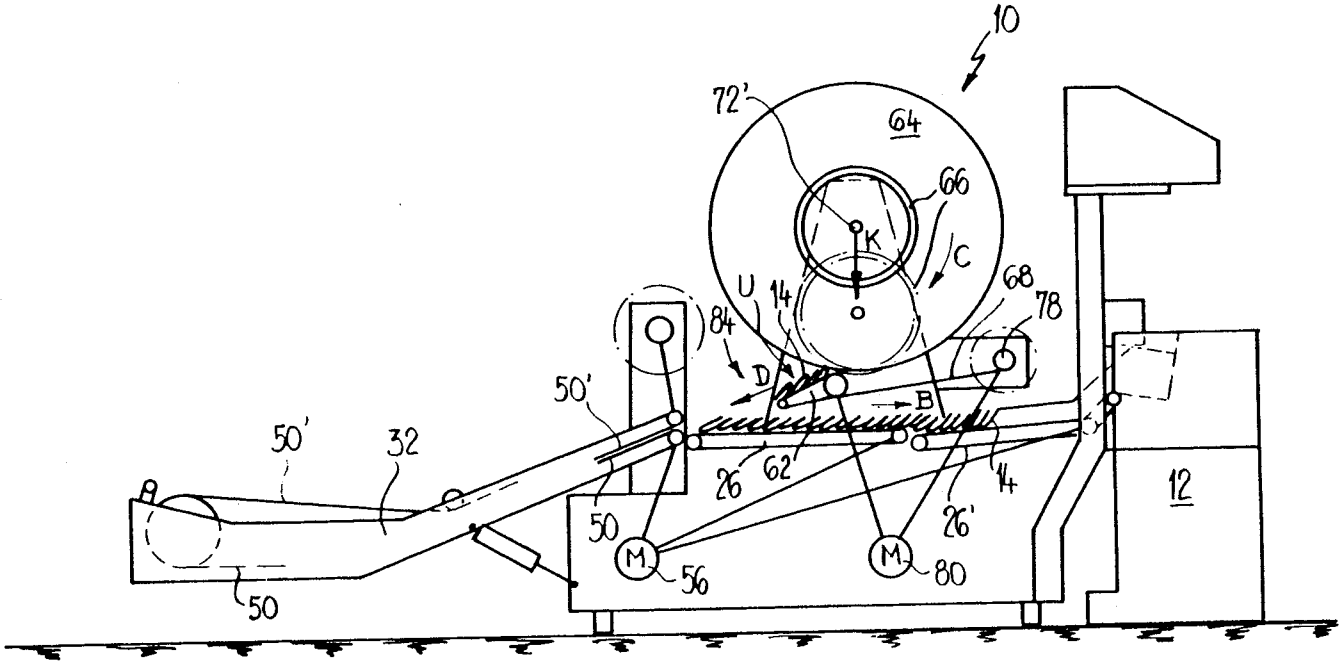
FIG. 2 illustrates in side view and in simplified schematic illustration an exemplary embodiment of a loading or charging apparatus for a feeder or feeder installation, depicting the imbricated buffer or imbricated buffer stack supplied by a buffer package.

Describing now the drawings, it is to be understood that to simplify the showing thereof, only enough of the construction of the apparatus for loading or charging a singling or separation installation for products, typically printed products, such as newspapers, magazines, periodicals or the like has been illustrated therein as is needed to enable one skilled in the art to readily understand the underlying principles and concepts of this invention. Turning now specifically to FIGS. 1 and 2, there has been shown in side view an exemplary embodiment of a loading or charging apparatus 10 for a feeder or feeder installation 12. This feeder or feeder installation 12 is of conventional design and therefore has not been here further illustrated, especially since details thereof are unimportant for understanding the teachings and principles of the present invention. It is noted, however, that such feeder or feeder installation 12 may be of the type disclosed, for instance, in Swiss Pat. No. 584,642, granted Dec. 31, 1976, to which reference may be had and the disclosure of which is incorporated herein by reference. Such feeder or feeder installation 12 may form part of a stapler or a collating machine. In such feeder or feeder installation 12 printed products 14 are removed in known manner from a product stack 16 in which these printed products 14 are arranged so as to be in alignment and in contact with one another at their side edges. This product stack 16 is located in a stack accommodating or receiving chamber or space 18.

A conveyor element or conveyor 20 is arranged upstream or forwardly of the stack accommodating or receiving chamber 18. Conveyor element 20 serves for advancingly feeding or forwarding the printed products 14 which are supplied by an infeed device or structure 22. This infeed device 22 comprises two partial conveyors or conveyor elements 26 and 26'. The conveying velocity of the partial conveyor 26 is greater than the conveying velocity of the partial conveyor 26'. In this way there is achieved the result that the printed products 14 infed by the partial conveyor 26, during their transition from the partial conveyor 26 to the partial conveyor 26', have the imbrication pitch altered and here specifically reduced so that the printed products 14 are erected or uprighted and form an imbricated or imbrication buffer or buffer stack. The conveyor or transport element 20 transports such printed products 14 in an inclined upwardly disposed position or posture such that these printed products 14 are displaced in a position or orientation approximately parallel to the printed products 14 arranged in the product stack 16 against such printed products 14 of this stack 16. The continuous erection or uprighting of the printed products 14 along the infeed device 22 and the conveyor element 20 results in a faultless displacement or shifting of the printed products 14 onto the product stack 16. The infeed device 22 and the conveyor element 20 are arranged at a frame or frame unit 28.

A buffer branch or branch arrangement or structure 30 is arranged above the infeed device 22 likewise at the frame or frame unit 28. The construction and mode of operation of the buffer branch arrangement or structure 30 will be described in greater detail hereinafter.

A rocker or balance mechanism or unit 32 which is pivotably mounted at the frame or frame unit 28 is arranged forwardly or upstream of the infeed device 22 and the buffer branch arrangement or structure 30. This rocker or balance mechanism 32 conveys an imbricated stream or formation T of printed products 14, arriving after being unwound from a product package or coil 34, to the loading or charging apparatus 10. The unwinding of the imbricated product stream T from the wound product package or package coil 34 by means of the rocker or balance mechanism 32 is accomplished in known fashion, for instance, as disclosed in the European Published patent application No. 142,745, and the cognate U.S. Pat. No. 4,597,541, granted July 1, 1986. The wound product package 34 possesses a winding core or core member 36 or the like, which is rotatably mounted in a winding frame or frame unit 38. The printed products 14 which are subsequently payed-off or outfed in the imbricated stream or formation T are previously wound onto the rotatably mounted winding core 36 together with a winding band or strap 40 or equivalent structure. The rocker or balance mechanism 32 is pressed by means of a suitable contact or press-on mechanism 42 against the wound product package 34, this contact or press-on mechanism 42 being supported at the frame or frame unit 28.

In the rocker or balance mechanism 32 there are arranged two revolvingly driven endless bands or belts 50 and 50' which collectively form a conveying gap or nip in which there is conveyed the imbricated stream or formation T of printed products 14 to the loading or charging apparatus 10. These endless bands or belts 50 and 50' are guided about the deflection rolls or rollers 46 and 48, respectively, and the conveying-active run of the endless band or belt 50 partially encircles or wraps about the deflection roll 46 coaxially with respect to the endless band or belt 50'. The conveying-active runs of these endless bands or belts 50 and 50' are guided in the rocker or balance mechanism 32 by means of not particularly illustrated but conventional guide rolls, as is well known in this technology, towards the deflection rolls 52 and 55. The winding band or strap 40 travels about coaxial freely rotatable rolls or rollers towards the deflection rolls 46 and 52 before it is wound upon a band or strap spool or spool member 54. This band spool or spool member 54 has been shown in phantom or chain-dot lines in FIG. 1 with the winding band or strap 40 completely wound thereupon. The band spool member 54 as well as the endless bands or belts 50 and 50', as schematically illustrated and as more fully described in the aforementioned European Published patent application No. 142,745 and the cognate U.S. Pat. No. 4,597,541, are driven by means of a suitable drive motor or drive means 56.

The partial conveyors or conveyor members 26 and 26' of the infeed device 22, as schematically illustrated, are likewise driven by means of the drive motor 56, it being noted that suitable gearing or transmissions with variable transmission ratios could be arranged between the drive motor 56 and the partial conveyors 26 and 26'. It is also conceivable to arrange such gearing or transmissions between the endless band or strap 50 and the band spool member 54.

The only schematically illustrated buffer branch arrangement or structure 30 possesses a separation arrangement or device 58 which removes or detaches the processed products, here the printed products 14 out of the arriving imbricated stream T of printed products, a conveyor arrangement or device 62 and a buffer package or package structure 64 containing the buffer winding core or mandrel or core member 66 and the printed products 70 which have been wound upon the buffer winding core 66 in imbricated formation U in conjunction with the buffer winding band or strap 68. The buffer winding core 66 is rotatably mounted upon a shaft or shaft member 72. This shaft 72 is mounted so as to be appropriately elevationally displaceable at a stand or upright portion 74 which is attached to the frame or frame unit 28. The shaft 72 thus travels or migrates as a function of the number of printed products 14 or the like, which have been wound upon the buffer winding core 66 to form the buffer package 64, the shaft 72 migrating from the position designated by reference numeral 72 to the position designated by reference numeral 72'. The conveyor arrangement or device 62 comprises a band or belt conveyor which can be bi-directionally driven in both possible directions of movement. This conveyor arrangement 62 contains a roll or roller 76 which is spatially stationarily mounted, and the buffer package 64 is adjusted in its elevational position such that it always bears or contacts a conveying-active run of the conveyor arrangement 62. By means of a suitable drive motor 80 the conveyor arrangement 62 can be bi-directionally driven in both conveying or movement directions.

A control console or cabinet 82 or the like, contains the appropriate means for the control and monitoring of the loading or charging apparatus 10 and the rocker or balance mechanism 32.

Turning attention now to FIG. 2 where the same reference characters have been generally conveniently used to designate the same components as employed in FIG. 1, it is here remarked that for purposes of improving comprehensibility only the reference numerals and associated structure have been indicated in FIG. 2 which are thought to be necessary for understanding the function of the loading or charging apparatus 10. In such FIG. 2 there has been illustrated the same loading or charging apparatus 10 as portrayed in FIG. 1, wherein however, the wound product package 34 depicted in FIG. 1 has here been shown to have been unwound and depleted and thus the now empty winding core or core member 36 must be exchanged for a full new wound product package 34. The arriving imbricated stream or formation T of printed products 14 is thus interrupted and the printed products 14 which are infed or delivered to the imbricated or imbrication buffer stack are unwound from the full buffer package 64 serving as a buffer storage.

The function of the loading or charging apparatus 10 depicted in FIGS. 1 and 2 will now be considered and is as follows:

During the product unwinding operation the wound product package or product coil 34 rotates in the direction of the arrow A and the printed products 14 which have been previously wound onto the product package 34 in imbricated formation detach or release from the product package 34 at the region of both of the deflection rolls or rollers 46 and 48 and are conveyed or transported, in the manner described above to the loading or charging apparatus 10. The printed products 14 which have been removed or detached out of the imbricated stream or formation T by the separation arrangement 58 are further conveyed by the conveyor arrangement 62 and are wound in conjunction with the buffer winding band or strap 68 unwound from the buffer winding spool 78 in imbricated formation U upon the buffer winding core or mandrel 66 or the thereon forming buffer package 64, as the case may be. The printed products 14 which are not removed or detached out of the arriving imbricated stream or formation T by the separation arrangement 58 are directly delivered or supplied by the infeed device 22 in the product conveying or feed direction B, as above explained, to the imbricated buffer stack S and the feeder or feeder installation 12.

Printed products 14 are removed for such length of time from the imbricated stream or formation T and delivered to the buffer package 64 until this buffer package 64 has been fully wound to the desired extent with the printed products 14. Thereafter, all further printed products 14 are directly conveyed or fed to the imbricated or imbrication buffer stack S. As a general rule, the buffer package 64 is filled before the wound product package 34 has become empty, so that in the presence of an interruption in the arriving imbricated stream T, for instance, due to a package change operation, the printed products 14 can be immediately delivered from the buffer package 64 to the infeed device 22.

In the presence of an interruption of the arriving imbricated stream T the printed products 14 are unwound from the buffer package 64, and thus the buffer winding band or strap 78 is appropriately driven by the drive motor 80. The shaft 72 of the buffer package 64, when the buffer package 64 is in a full state or condition, is located in the uppermost position 72' as shown in FIG. 2. During unwinding of the printed product 14 from the buffer package 64 the diameter thereof decreases and the shaft 72 is downwardly displaced in the direction of the arrow K until finally the buffer package core or mandrel member 66 of the empty buffer package 64 has assumed the phantom line or chain-dot position (see FIG. 1). During this unwinding operation the buffer package 64 is slightly braked by a not particularly illustrated but conventional brake device, and the rotation of the buffer package 64 in the direction of the arrow C occurs solely by the action of the tension of the buffer winding band or strap or tape 68. The conveyor arrangement 62 is driven in such a fashion that the conveying-active run thereof moves in the direction of the arrow D. This conveyor arrangement 62 conveys or feeds the imbricated stream U which has been unwound or payed-off from the buffer package 64 to a conveyor element 84 which has only been generally schematically represented by an arrow in FIG. 2. This conveyor element 84 transfers the printed products 14 of the imbricated stream or formation U to the infeed device 22. These operations will again be considered in more detail later on.

Figure 3:
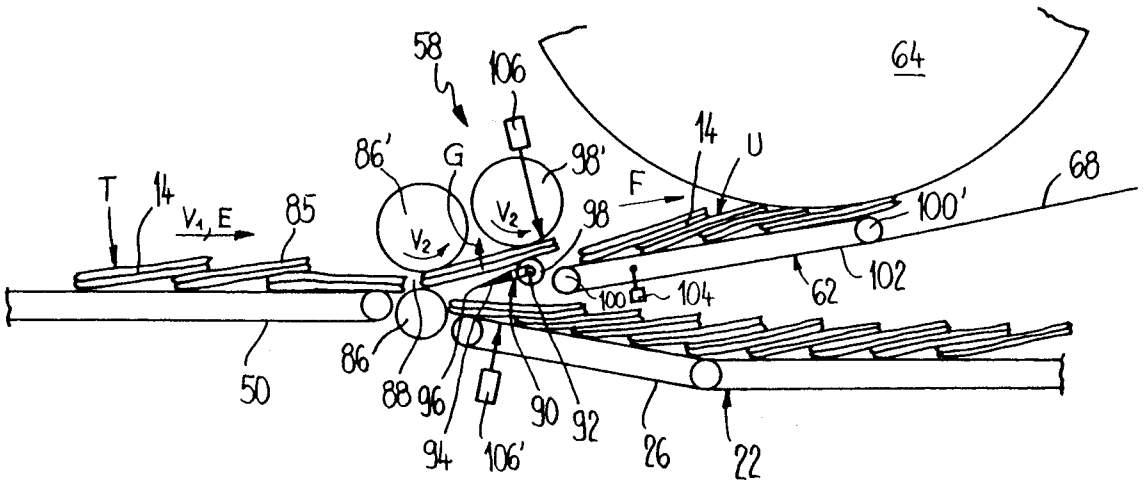
FIG. 3 illustrates on an enlarged scale in relation to FIGS. 1 and 2 and in side view an exemplary embodiment of the separation and conveyor arrangement serving for removing or releasing or detaching printed products out of the arriving imbricated stream or formation of printed products and for conveying such to the buffer package.
Figure 4:
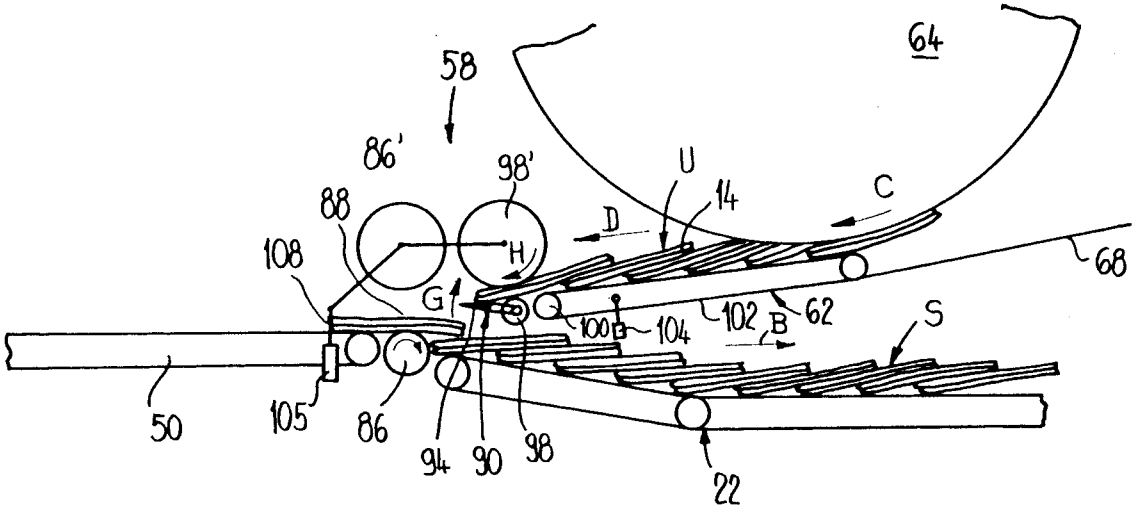
FIG. 4 again illustrates on an enlarged scale in relation to FIGS. 1 and 2 and in side view the exemplary embodiment of the separation and conveyor arrangement shown in FIG. 3 serving for removing or releasing printed products out of the arriving imbricated stream or formation of printed products but now depicted in an operational mode where the prior wound products of the buffer package are delivered from such buffer package.

In FIGS. 3 and 4 there has been depicted an exemplary embodiment of the separation and conveyor arrangement 58, 62 as well as the conveyor element 84 on an enlarged scale. As to the rocker or balance mechanism 32 there has only been conveniently shown the endless band or belt 50 in such FIGS. 3 and 4.

In the arrangement of FIG. 3, and in contrast to that of FIG. 1, in the arriving or inbound imbricated stream or formation T in each case two printed products 14 repose upon one another so that they form a printed product pair 85. These printed product pairs 85 are also arranged in shingled or imbricated formation upon one another. Viewed in the conveying direction E of the arriving imbricated stream or formation T of printed products 14 an acceleration roller or roll pair 86 and 86' is arranged after or downstream of the endless band or belt 50.

The printed product pair 85 of the arriving imbricated stream or formation T, located closest to the acceleration roll pair 86 and 86', is introduced into a conveying gap or nip 88 formed between both of the acceleration or accelerating rolls or rollers 86 and 86'. Since the outer surfaces of the acceleration rolls or pair of rollers 86 and 86' move in the direction of the depicted arrow with the velocity $V_2$, which is appreciably larger than the velocity $V_1$ of the arriving imbricated stream T of printed products 14, the printed product pair 85 located in the conveying gap or nip 88 is accelerated and removed or detached from i.e. singled out of the imbricated stream or formation T. A switch mechanism or unit 90 is arranged following or downstream of the pair of acceleration rolls or rollers 86 or 86'. This switch mechanism 90 comprises a switch element 94 which is pivotably mounted at a shaft or shaft member 92 and which protrudes towards the pair of acceleration rolls 86 and 86'. In the switch position depicted in FIG. 3 the pivotal end 96 of the switch element 94 is pivoted or rocked below a conveying path defined by the arriving imbricated stream or formation T, the acceleration roll pair 86 and 86', a pair of acceleration rolls or rollers 98 and 98' and the conveyor arrangement or device 62. Consequently, the accelerated printed product pair 85 located in the conveying gap or nip 88 runs onto the switch element 94 and is transferred into the buffer branch arrangement or structure 30. The printed product pair 85 which has been displaced onto the switch element 94 is engaged or nipped by the pair of acceleration rolls or rollers 98 and 98' before it has departed from the conveying gap 88 of the pair of acceleration rolls or rollers 86 and 86'. The circumferential velocity of this pair of acceleration rolls or rollers 98 and 98' also amounts to $V_2$. The lower roll 98 of the acceleration roll pair 98 and 98' is mounted upon the shaft 92 upon which there is also mounted the switch element 94.

The conveyor arrangement 62 comprises a revolving band or belt 102 which can be bi-directionally driven in both directions of movement and which trains about two rotatably mounted rolls or rollers 100 and 100'. The roll 100' is stationarily arranged whereas the roll 100 can be adjusted in its elevational position by means of a cylinder or cylinder drive 104, typically a fluid-operated piston-and-cylinder unit. The buffer winding band or strap 68 travels about a freely revolving roll which is coaxially arranged with respect to the roll or roller 100' and is then delivered in conjunction with the printed product pairs 85 to the buffer package or product coil 64. The buffer package 64 is driven during the winding-up operation by a not particularly illustrated but conventional drive motor, whereas the buffer winding band spool or spool member 78 is slightly braked, so that the buffer winding band or strap 68 always is subjected to a predeterminate tension or tensile load. During winding-up of the printed products pairs 85 upon the buffer package 64 the band or belt conveyor arrangement or device 62 is driven in the conveying direction F and downwardly rocked or pivoted, so that the conveying-active run of the band or bolt 102 comes to lie beneath the product conveying path. This results in the printed product pair 85 located in the conveying gap or nip of the acceleration roll pair 98 and 98' coming to lie in imbricated formation upon the printed product pair 85 which has been previously been deposited upon the band or belt conveyor arrangement or device 62. Consequently, there is formed the imbricated product formation U which is wound-up in conjunction with the winding band or strap 68 upon the buffer package or product coil 64.

As will be recognized by inspecting FIG. 3, a light barrier 106 or equivalent detector arranged at the acceleration roll pair 98 and 98' detects the leading edge of the printed product pair 85 which has been introduced into the buffer branch arrangement or structure 30 and a further light barrier 106' or equivalent detector detects the leading edge of the printed product pair 85 which, when the switch element 94 is pivoted in the direction of the arrow G, is directly conveyed or supplied to the infeed device 22.

In the illustration of FIG. 4 printed products 14, in the form of, for instance pairs of printed products, like the product pairs 85 depicted in FIG. 3, are unwound from the buffer package 64 and delivered to the infeed device 22, it being noted the arriving imbricated stream or formation T (FIG. 3) of printed products 14 is interrupted or exhausted. The separation or separator arrangement 58 here fulfills the function of the prior discussed conveyor element indicated in FIG. 2 with the arrow 84. The acceleration roll or roller 98' is driven in the direction of rotation H and the switch element 94 is pivoted in the direction of the arrow G. The acceleration roll 86' is upwardly rocked or pivoted by means of a cylinder unit 105 or the like, typically a fluid-operated piston-and-cylinder unit and thereby spaced at such a distance from the acceleration roll or roller 86 that it no longer can act upon the printed product pairs 85. A stop or impact member 108 is introduced into the product conveying path due to the operation of the cylinder unit 105, so that the printed product pairs 85 of the imbricated stream or formation U, which have been singled or separated by the acceleration roll pair 98 and 98', impact or abut against such stop or impact member 108.

The function of the separation or separator arrangement 58 will now be briefly reiterated. The printed product pairs 85 of the arriving imbricated stream or formation T are singled or separated by means of the acceleration roll pair 86 and 86' and delivered to the switch mechanism or unit 90. If the singled printed product pairs 85 should be conveyed or delivered to the buffer package or product coil 64, then initially the switch element 94 is downwardly rocked or pivoted in response to a suitable command from the control console or control means 82. The printed product pair 85 which has been deflected by the acceleration roll 98 and 98' is engaged by such pair of acceleration rolls or rollers 98 and 98' and deposited upon the conveyor arrangement 62 which has been downwardly pivoted or rocked by the cylinder unit 106 in order to form a step structure. The thus formed imbricated stream or formation U of printed products is wound-up in conjunction with the winding band or strap 68 upon the winding core or mandrel 66 or the product package 64, as the case may be.

The light barrier 106 detects the leading edge of each printed product pair 85 as soon as such depart from the acceleration roll pair 98 and 98' and delivers an appropriate pulse to the control console or cabinet 82. If the next printed product pair 85 of the arriving imbricated stream T also must be delivered to the buffer package 64, then the switch element 94 is not switched or shifted from its present position and the just described operation is repeated. On the other hand, if this printed product pair 85 must be directly conveyed to the imbricated buffer or imbricated buffer stack S, then the control console 82, following receipt of a pulse from the light barrier 106, delivers a switch pivot or shift command to the switch element 94 which then rocks or pivots in the direction of the arrow G. The printed product pair 85 which has been singled by the action of the acceleration roll pair 86 and 86' is now directly conveyed to the partial conveyor 26 and at that location forms in conjunction with the already present printed product pairs 85 the imbricated stream or formation S. The light barrier 106' detects the leading edge of this printed product pair 85 arriving at the partial conveyor 26 and also delivers a synchronization pulse to the control console or means 82. This control console 82 now determines the next positional shifting of the switch element 94 as a function of such synchronization pulse.

After a sufficient quantity of printed product pairs 85 have been stored upon the buffer package or product coil 64, then all further printed product pairs 85 of the infed imbricated stream or formation T are directly conveyed to the imbricated buffer stack S. Now if the arriving imbricated stream or formation T is interrupted, for instance because a package change operation must be undertaken, then the printed product pairs 85 which have been previously stored upon the buffer package or product coil 64 are delivered to the infeed device 22. Since, as above-described, the buffer package 64 as a general rule, is filled before the arriving imbricated stream or formation T is interrupted, the buffer branch arrangement or structure 30 is immediately ready to deliver the stored printed products 14. The control console or control means 82 delivers control commands to the cylinder unit 104 which upwardly rocks or pivots the roll or roller 100 of the conveyor arrangement 62, control commands to the switch unit 90 so that there is ensured that the switch element 94 will be rocked in the direction of the arrow G and to the cylinder unit 105 which extends or thrusts out the stop or impact member 108 and upwardly rocks the acceleration roll or roller 86'. The acceleration roll or roller 98' is driven in the direction of the arrow H and under the tensile load or force exerted by the buffer winding band or strap 68 the buffer package 64 begins to rotate in the direction of the arrow C. The printed product pairs 85 of the imbricated stream or formation U unwound from the buffer package or product coil 64 are singled or separated by the acceleration roll pair 98 and 98' and come into contact with the stop or impact member 108. The conveying-active run of the band or belt 102 moves in the direction of the arrow D at the same velocity as the winding band or strap 68. The printed product 85 which bears or strikes against the stop or impact member 108 is conveyed by means of the acceleration roll or roller 86 to the infeed device 22 and at that location comes to bear or repose upon the printed product pair 85 of the imbricated stream or formation S which is rearmost when viewed with regard to the product conveying direction B.

Also the conveying velocities of the endless bands or belts 50 and 50', the infeed device 22, the acceleration roll pair 86 and 86', the further acceleration roll pair 98 and 98' as well as the buffer winding core or mandrel 66 and the band or strap spool members 54 and 78, respectively, are governed by the controls arranged in the control console or control means 82.

At the arriving imbricated stream T the individual printed products 14 can be arranged in imbricated or shingled formation, as such has been depicted in FIG. 1, or printed product pairs 85 can be arranged in imbricated or shingled formation, as such has been depicted in FIG. 3. The separation or separator arrangement 58 illustrated in FIGS. 3 and 4 is independent of such product arrangements, in other words, can process both such product configurations.

Since the individual printed products 14 or printed product pairs 85 of the arriving imbricated stream or formation T are singled or separated, it is possible that, for instance, each second printed product 14 or printed product pair 85, or even entire sections of a multiplicity or plurality of printed products 14 or printed product pairs 85, as the case may be, can be delivered to the buffer product package or product coil 64.

The separation or separator arrangement 58 also can be differently constructed than in the manner illustrated and described with respect to the existing figures of the drawings. Thus, for instance, a simple deflection plate or plate member can separate the printed products 14 of the arriving imbricated stream or formation T from one another if such printed products are arranged alternately in laterally shifted or offset relationship. A similar deflection plate can also separate the printed product pairs 85 from one another when the printed products within the printed product pairs 85 are likewise laterally offset or shifted with respect to one another. In such case, by means of the deflection plate the upper printed product of each printed product pair 85 can be separated out and inputted or delivered to the buffer branch or arrangement or structure 30. Such a separation apparatus or device is disclosed in Swiss Pat. No. 655,489 and the cognate U.S. Pat. No. 4,569,488, granted Feb. 11, 1986, to which reference may be readily had and the disclosure of which is incorporated herein by reference.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of loading a processing apparatus for printed products, and comprising the steps of forming an arriving imbricated stream of printed products, singling the printed products of the arriving stream, forming the singled printed products into an imbricated buffer stack leading to the processing apparatus and including reducing the imbrication pitch of the products, selectively removing some of the singled printed products to a buffer package and winding the products thereupon, unwinding the printed products from the buffer package upon an interruption of the arriving imbricated stream, and delivering the unwound printed products in imbricated formation to said imbricated buffer stack.

2. The method as defined in claim 1, wherein the step of selectively removing some of the singled printed products to a buffer package and winding the products thereupon includes winding the printed products in an imbricated formation upon the buffer package.

3. The method as defined in claim 1, wherein the step of forming an arriving imbricated stream of printed products includes the step of:

unwinding the printed products from a product package containing wound-up printed products and forming the unwound products into said arriving imbricated stream of printed products.

4. The method as defined in claim 1, wherein each of the printed products of the arriving imbricated stream of printed products is composed of a pair of superposed product elements.

5. The method as defined in claim 4, wherein the step of selectively removing some of the singled printed products to a buffer package includes removing each second pair of superposed product elements from the arriving imbricated stream of printed products.

6. The method as defined in claim 4, wherein the step of selectively removing some of the singled printed products to a buffer package includes removing sections containing a multiplicity of pairs of superposed product elements from the arriving imbricated stream of printed products to the buffer arrangement.

7. The method as defined in claim 1, wherein the step of selectively removing some of the singled printed products to a buffer package includes removing each second printed product from the arriving imbricated stream of printed products.

8. The method as defined in claim 1, wherein the step of selectively removing some of the singled printed products to a buffer package includes removing sections containing a multiplicity of printed products arranged in imbricated formation from the arriving imbricated stream of printed products to the buffer arrangement.

9. The method as defined in claim 2, wherein the step of unwinding the printed products from the buffer package includes singling the printed products which have ben unwound from the buffer package; and wherein the step of delivering the unwound printed products includes delivering the singled printed products unwound from the buffer package such that edges which were trailing during the unwinding of the printed products from the buffer package are delivered as leading edges in a newly formed imbricated stream of printed products; and delivering the newly formed imbricated stream of printed products to the imbricated buffer stack.

10. An apparatus for loading a processing apparatus for printed products, such as a feeder installation, and comprising:

an infeed device for reducing the imbrication pitch of printed products of an arriving imbricated stream of printed products so as to form an imbricated buffer stack, the printed products of which are adapted to be delivered to the processing apparatus;

a bi-directionally rotatably mounted buffer package core for forming thereon a buffer package;

conveyor means located between the infeed device and the buffer package core for the selective infeed of printed products to the buffer package core for forming thereon a buffer package and for the outfeed of printed products removed from the buffer package;

separation means for removing printed products from the arriving imbrication stream of printed products and for delivering the removed printed products to the conveyor means;

said separation means comprising a singling device which singles the printed products of the arriving imbricated stream of printed products, switch means arranged following the singling device when viewed with respect to the conveying direction of the arriving imbricated stream of printed products; and means for moving said switch means selectively between at least two predetermined positions, and including a first predetermined position enabling formation of a new imbricated stream of printed products delivered to the imbricated buffer stack, and a second predetermined position infeeding a newly formed imbricated stream of printed products to the conveyor means.

11. The apparatus as defined in claim 10, further including:

means for delivering the arriving imbricated stream of printed products and wherein each of the printed products of the arriving imbricated stream is composed of a pair of superposed product elements.

12. The apparatus as defined in claim 10, wherein:

said conveyor means comprises band conveyor means.

13. The apparatus as defined in claim 10, further including:

an additional singling device operable during the outfeed of printed products removed from the buffer package and for delivering the printed products to the infeed device such that upon unwinding printed products from the buffer package trailing edges of the unwound printed products come to lie as leading edges upon the infeed device.

14. The apparatus as defined in claim 10, wherein:

said singling device comprises first and second pairs of acceleration rolls; and said switch means comprises a pivotably mounted switch element;

said switch element having a pivotable end portion protruding towards the first pair of acceleration rolls and such that said pivotable end portion can be rocked beneath a conveying path defined by the arriving imbricated stream of printed products, the first acceleration roll pair, the second acceleration roll pair and the conveyor means.

15. The apparatus as defined in claim 14, further including:

means for pivotably mounting said switch element; and said pivotably mounting means comprising a rotatable shaft to which there is mounted one roll of said second pair of acceleration rolls.

16. The apparatus as defined in claim 14, further including:

means for selectively driving said second pair of acceleration rolls in opposite rotational directions.

17. The apparatus as defined in claim 14, wherein:

said conveyor means includes a first end portion located towards the buffer package and a second end portion located towards the switch means;

means for pivotably mounting the first end portion of the conveyor means;

said second end portion of the conveyor arrangement being pivotable beneath a predeterminate conveying path for the printed products; and means for elevationally displaceably mounting said buffer package core such that said buffer package core or the package of printed products wound thereupon can be brought into bearing contact with said conveyor means.

18. The apparatus as defined in claim 14, wherein:

said first pair of acceleration rolls includes an upper roll; and means for enabling pivoting of the upper roll of the first pair of acceleration rolls out of an effective region acting upon the printed products.

19. The apparatus as defined in claim 14, further including:

means for rotatably driving said second pair of acceleration rolls so as to define an additional singling device;

said additional singling device singling printed products unwound from the buffer package and delivering the printed products to the infeed device such that upon unwinding printed products from the buffer package trailing edges of the unwound printed products come to lie as leading edges upon the infeed device;

stop means;

means for introducing said stop means into the region of the conveying path for the printed products and at a located downstream of said second pair of acceleration rolls when viewed in the direction of feed of said second pair and such that the printed products are unwound from the buffer package and singled towards said stop means.

20. The apparatus as defined in claim 10, further including:

wound product package means arranged upstream of said separating means and from which there is unwound the arriving imbricated stream of printed products.

21. The apparatus as defined in claim 10, wherein:

said buffer package core, said separation means and said conveyor means are arranged above said infeed device.

22. A method of loading a processing apparatus for printed products, such as a feeder installation, with printed products delivered in an imbricated formation, comprising the steps of:

forming an imbricated buffer stack forwardly of the processing apparatus and including reducing the imbrication pitch of an arriving imbricated stream of printed products;

selectively removing some of the printed products from the arriving imbricated stream of printed products to a buffer arrangement;

winding-up the removed printed products at said buffer arrangement to form a buffer package and including winding-up the printed products in an imbricated formation upon the buffer package;

unwinding the printed products from the buffer package upon interruption of the arriving imbricated stream of printed products, and including singling the printed products which have been unwound from the buffer package; and delivering the printed products unwound from the buffer package to the imbricated buffer stack, and including delivering the singled printed products unwound from the buffer package such that edges which were trailing during the unwinding of the printed products from the buffer package are delivered as leading edges in a newly formed imbricated stream of printed products, and delivering the newly formed imbricated stream of printed products to the imbricated buffer stack.

* * * * *

UNITED STATES PATENT AND TRADEMARK OFFICE

CERTIFICATE OF CORRECTION

PATENT NO. : 4,953,843

DATED : September 4, 1990

INVENTOR(S) : Walter Reist

It is certified that error appears in the above-identified patent and that said Letters Patent is hereby corrected as shown below:

Column 12, line 53, "ben" should be -- been --

Column 13, line 16, "imbrication" should be -- imbricated --

Column 14, line 53, "separating" should be -- separation --

Signed and Sealed this

Twenty-first Day of July, 1992

*Attest:*

DOUGLAS B. COMER

*Attesting Officer*

*Acting Commissioner of Patents and Trademarks*